US011627799B2

(12) United States Patent
McRobert et al.

(10) Patent No.: US 11,627,799 B2
(45) Date of Patent: Apr. 18, 2023

(54) SLIDABLE WORK SURFACE

(71) Applicant: Keith McRobert, Spring Lake, MI (US)

(72) Inventors: Keith McRobert, Spring Lake, MI (US); William Gregory Book, Holland, MI (US); Zachary Davidson Graves, Lowell, MI (US); Benjamin Booth Edinger, Grand Haven, MI (US); Michael A. Johnson, Grand Haven, MI (US)

( * ) Notice: Subject to any disclaimer, the term of this patent is extended or adjusted under 35 U.S.C. 154(b) by 0 days.

(21) Appl. No.: 17/537,106

(22) Filed: Nov. 29, 2021

(65) Prior Publication Data

US 2022/0175132 A1 Jun. 9, 2022

Related U.S. Application Data

(60) Provisional application No. 63/121,352, filed on Dec. 4, 2020.

(51) Int. Cl.
*A47B 21/00* (2006.01)
*A47B 21/03* (2006.01)

(52) U.S. Cl.
CPC .... *A47B 21/0314* (2013.01); *A47B 2200/004* (2013.01)

(58) Field of Classification Search
CPC ..... A47B 21/0314; A47B 21/03; A47B 1/10; A47B 13/081; A47B 17/03; A47B 41/02; A47B 2200/004
USPC ..... 108/142, 143, 20–22, 32; 312/201, 333, 312/196, 223.3, 319.9
See application file for complete search history.

(56) References Cited

U.S. PATENT DOCUMENTS 242,309 A * 5/1881 Harriman ..... A47B 21/0314
744,888 A * 11/1903 Widman ..... A47B 21/00 312/351
1,692,665 A * 11/1928 Knaster
1,888,478 A * 11/1932 Steidl
2,815,252 A * 12/1957 Baker
4,483,572 A * 11/1984 Story ..... A47B 21/0214
4,657,214 A * 4/1987 Foster ..... A47B 21/0314
4,766,422 A * 8/1988 Wolters ..... G06F 1/16 348/836
5,172,641 A 12/1992 Auer
(Continued)

FOREIGN PATENT DOCUMENTS

CN 2638527 9/2004
CN 2815087 9/2006
(Continued)

*Primary Examiner* — Janet M Wilkens
(74) *Attorney, Agent, or Firm* — Oppenhuizen Law PLC; David L. Oppenhuizen

(57) ABSTRACT

A workstation is disclosed. The workstation includes a tabletop or desktop having a work surface assembly that has a base structure, a cover member, and a brake assembly. The cover member is supported by the base structure and defines a work surface arranged at an inclination relative to a horizontal surface. The cover member is adapted to slide relative to the base structure between an extended position and a retracted position. Moreover, the brake assembly is adapted to prevent the sliding of the cover member relative to base structure and holds the cover member stationary with the base structure.

18 Claims, 6 Drawing Sheets

(56) References Cited

U.S. PATENT DOCUMENTS

| | | | | |
|---|---|---|---|---|
| 8,371,237 | B2 | 2/2013 | Weber | |
| 8,386,075 | B2 * | 2/2013 | Lockwood et al. | G07F 17/10 |
| 8,689,704 | B2 * | 4/2014 | Hodges | A61B 46/10 312/319.9 |
| 11,083,284 | B1 * | 8/2021 | Koga | A47B 13/081 |
| 2008/0315739 | A1 * | 12/2008 | Hirano | A47B 88/12 |
| 2014/0042886 | A1 * | 2/2014 | Baldo | F25D 23/028 312/405.1 |

FOREIGN PATENT DOCUMENTS

| | | | |
|---|---|---|---|
| CN | 2879797 | | 3/2007 |
| CN | 202950219 | U | 5/2013 |
| CN | 208941228 | U | 6/2019 |
| CN | 210727072 | U | 6/2020 |
| CN | 113679176 | * | 11/2021 |
| EP | 181843 | * | 5/1986 |
| KR | 20160003112 | * | 9/2016 |
| KR | 20170143109 | * | 12/2017 |

* cited by examiner

SLIDABLE WORK SURFACE

CROSS REFERENCE TO RELATED APPLICATION

This application claims the benefit of U.S. Provisional Application 63/121,352, which was filed on Dec. 4, 2020, the disclosure of which is hereby incorporated by reference.

BACKGROUND OF THE INVENTION

1. Field of the Invention

The present disclosure pertains to a workstation such as a table or desk. More particularly, the present disclosure pertains to a table or desk having a movable work surface assembly.

2. Description of the Prior Art

Tables and desks are well-known in the prior art for many uses, and they generally include a tabletop (or desktop) and one or more legs extending downwardly therefrom. For keyboarding, mousing and monitor work, reading, learning, or working on such a table or desk, a user has to sit in a forward or upright position in order to effectively view and reach the task. However, when intensive keyboarding, mousing and monitor work, learning, reading, or working is needed, the user occasionally wants to move to a reclined position, but tables and desks generally do not support keyboarding, mousing and monitor work, reading or learning in a reclined position. Therefore, a workstation is needed that can facilitate keyboarding, mousing and monitor work, reading, learning, or working both in an upright position and a reclined position.

SUMMARY OF THE INVENTION

According to an aspect of the disclosure a workstation is disclosed having a tabletop including a tabletop surface and a work surface assembly. The work surface assembly includes a base structure having a bottom plate; a cover member supported by the base structure and defining a work surface arranged at an inclination relative to the tabletop surface, the cover member is adapted to slide relative to the base structure between an extended position and a retracted position; and a brake assembly adapted to selectively prevent the cover member from sliding relative to base structure and hold the cover member stationary with the base structure at any position between the extended position and the retracted position.

According to another aspect of the disclosure, a work surface assembly for placement on a tabletop is disclosed. The work surface assembly comprises a base structure having a bottom plate; a cover member supported by the base structure and defining a work surface arranged at an inclination relative to the tabletop surface, the cover member is adapted to slide relative to the base structure between an extended position and a retracted position; and a brake assembly adapted to selectively prevent the cover member from sliding relative to base structure and hold the cover member stationary with the base structure at any position between the extended position and the retracted position.

Optionally, the brake assembly includes a ramp structure positioned atop the bottom plate of the base structure, the ramp structure extending upwardly from the bottom surface, and the ramp structure having a bottom surface, a front edge, a rear edge, a first side surface, a second side surface, and an inclined surface extending upwardly from the front edge to the rear edge, the ramp structure further including a plurality of first teeth arrayed linearly between the front edge and the rear edge.

Optionally, the ramp structure includes a plurality of second teeth arrayed linearly between the front edge and the rear edge, the plurality of first teeth being positioned along the first side surface and the plurality of second teeth being positioned along the second side surface, and the plurality of first teeth and the plurality of second teeth extending toward one another.

Optionally, the brake assembly includes a brake structure adapted to slidingly engage with the ramp structure, the brake structure being secured to the cover member, the brake structure is selectively engaged or disengaged with the ramp structure, and the brake structure is biased to be engaged with the ramp structure.

Optionally, the brake structure includes a pivoting lever having a first linear structure, and a second linear structure that is opposed to the first linear structure, and a fulcrum positioned between the first linear structure and the second linear structure.

Optionally, the second linear structure includes a first toothed member, and the first linear structure includes a second toothed member, and the first toothed member and second toothed member are positioned between the plurality of first teeth and the plurality of second teeth, whereby the brake structure is selectively engaged when the pivoting lever is rotated such that the first toothed member engages with the first teeth of the ramp structure, and the second toothed member engages with the second teeth of the ramp structure, and whereby the brake structure is selectively disengaged when the pivoting lever is rotated such that the first toothed member disengages from the first teeth of the ramp structure, and the second toothed member disengages from the second teeth of the ramp structure.

Optionally, the brake structure includes a spring that biases the brake structure to be engaged with the ramp structure.

Optionally, there is provided a cable attached on a first end to the pivoting lever and attached on a second end to a switch, whereby the switch can be selectively activated to move the pivoting lever to cause the brake structure to be engaged or disengaged with the ramp structure.

Optionally, there is provided a storage chamber within the base structure.

Optionally, there is provided at least one desk slider attached to the cover member and the base structure to allow the cover member to slide over the base structure.

For a more complete understanding of the present invention, reference is made to the following detailed description and accompanying drawings. In the drawings, like reference characters refer to like parts throughout the views in which:

DETAILED DESCRIPTION OF A PREFERRED EMBODIMENT

Figure 1:
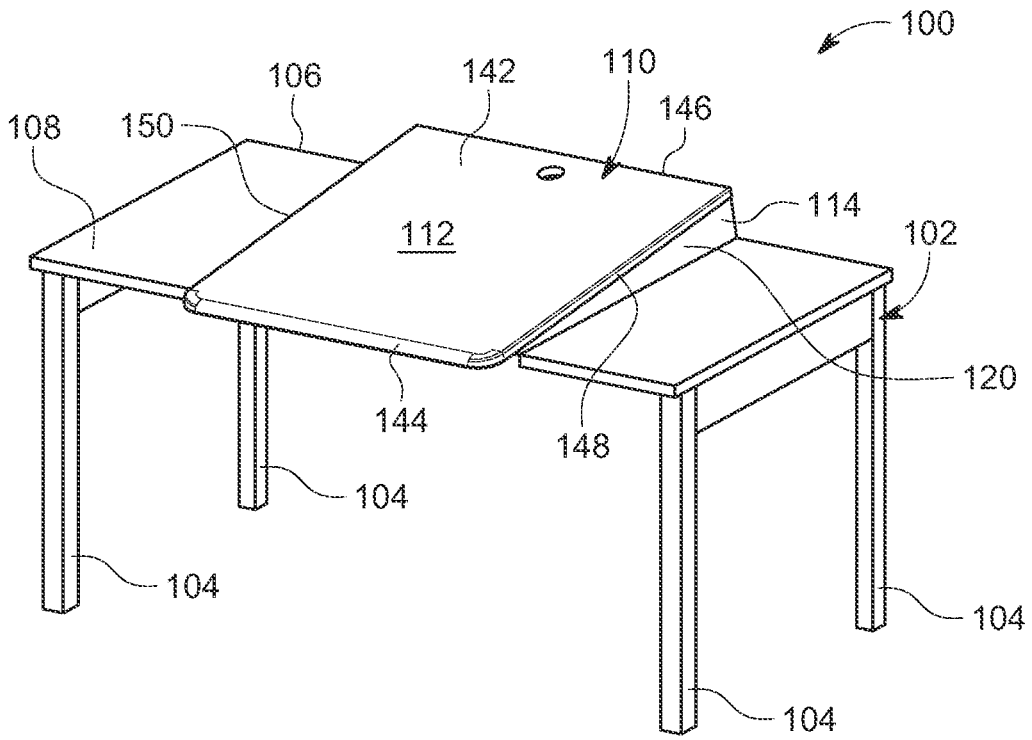
FIG. 1 illustrates a perspective view of a table having a work surface assembly, in accordance with an embodiment of the disclosure.

Referring to FIG. 1, an exemplary workstation 100 (hereinafter "table") is shown. The table 100 includes a frame 102 having a plurality of legs 104 adapted to facilitate a standing of the table 100 on a surface, for example, a ground surface, and a tabletop 106 supported by the legs 104 and disposed at a distance upward from the ground surface. As shown, the tabletop 106 may include a tabletop surface 108 attached to the legs 104, and a work surface assembly 110 attached/engaged with the tabletop surface 108 and adapted to provide a movable work surface 112. The moveable work surface 112 is arranged at an inclination relative to the tabletop surface 108 and provides an inclined/slanted work surface. As referenced herein, the table 100 is meant to encompass a desk or any other type of article of furniture that is generally understood to have a top surface for working at and/or placing things atop. Likewise, the tabletop 106 is meant to encompass a desktop as well.

As shown in FIGS. 1 to 4, the work surface assembly 110 includes a base structure 114 engaged to the tabletop surface 108 and having a bottom plate 118, a pair of sidewalls 120, 122 extending outwardly and perpendicularly from the bottom plate 118, and a rear wall 124 extending outwardly and perpendicularly from the bottom plate 118 and connecting the pair of sidewalls 120, 122. As shown, the rear wall 124 extends between the pair of sidewalls 120, 122 and is arranged substantially perpendicularly to the pair of sidewalls 120, 122. The pair of sidewalls, for example, a first sidewall 120 and a second sidewall 122 are arranged spaced apart and substantially parallel to one another. The first sidewall 120 and the second sidewall 122 define a pair of ramps 128, 130 extending rearwardly and obliquely from a location proximate to a front edge 132 of the bottom plate 118 to the rear wall 124. Accordingly, a height of each of the sidewalls 120, 122 increases in a direction towards the rear wall 124 from the front edge 132 of the bottom plate 118. The bottom plate 118, the sidewalls 120, 122, and the rear wall 124 together define a storage space/chamber 134 for optionally positioning a tray 136 for storing one or more articles. Furthermore, a top edge 138 of the base structure 114 defines an access opening 140 to facilitate an access of the storage chamber 134.

Figure 2:
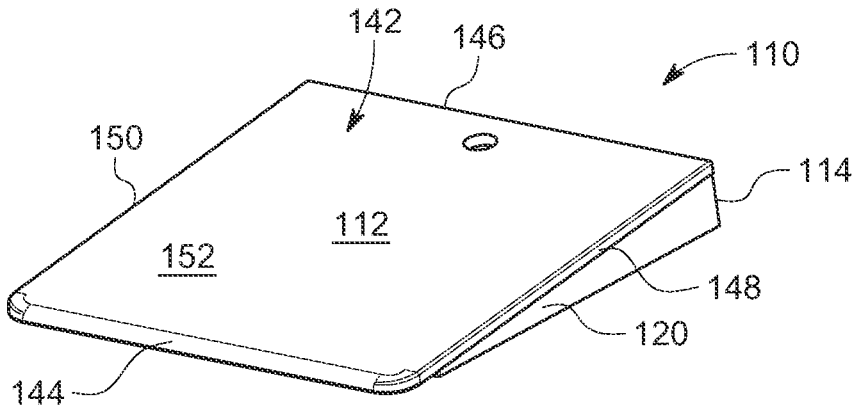
FIG. 2 illustrates a perspective view of the work surface assembly of FIG. 1 in accordance with an embodiment of the disclosure.

The work surface assembly 110 includes a cover member 142 adapted to cover the access opening 140 and slide relative to the base structure 114. The cover member 142 is supported by the sidewalls 120, 122, and hence is supported by the base structure 114. As shown, the cover member 142 may be a substantially rectangular structure, and may include a first edge 144 (i.e., front edge 144), a second edge 146 (i.e., rear edge 146) disposed opposite to the first edge 144, a third edge 148 extending from the front edge 144 to the rear edge 146, and a fourth edge 150 disposed spaced apart and opposite to the third edge 148. The fourth edge 150 also extends from the front edge 144 to the rear edge 146, and is arranged proximate to the second sidewall 122, while the third edge 148 is disposed proximate to the first sidewall 120. The cover member 142 includes a first surface 152 defining the work surface 112, and a bottom second surface 154 arranged opposite to the first surface 152 and facing the bottom plate 118. As shown, the cover member 142 is arranged at an inclination relative to the bottom plate 118 and is adapted to be positioned above and slide above the sidewalls 120, 122 between a retracted position and an extended position. In the retracted position, the cover member 142 completely closes the access opening 140 (as shown in FIGS. 1 and 2) and is arranged such that the rear edge 146 of the cover member 142 is arranged above (or proximate to) the rear wall 124. Furthermore, in the extended position, the rear edge 146 is disposed proximate to the front edge 132 of the bottom plate 118. Accordingly, in the extended position, the cover member 142 extends outwardly of the tabletop surface 108 in a longitudinal direction. Thus, the cover member 142 can slide along the tabletop surface 108 in a downward inclination toward a user seated at the workstation 100, thereby allowing any contents atop the work surface 112 to be positioned closer to a user that is seated in a rearward-leaning position.

Figure 3:
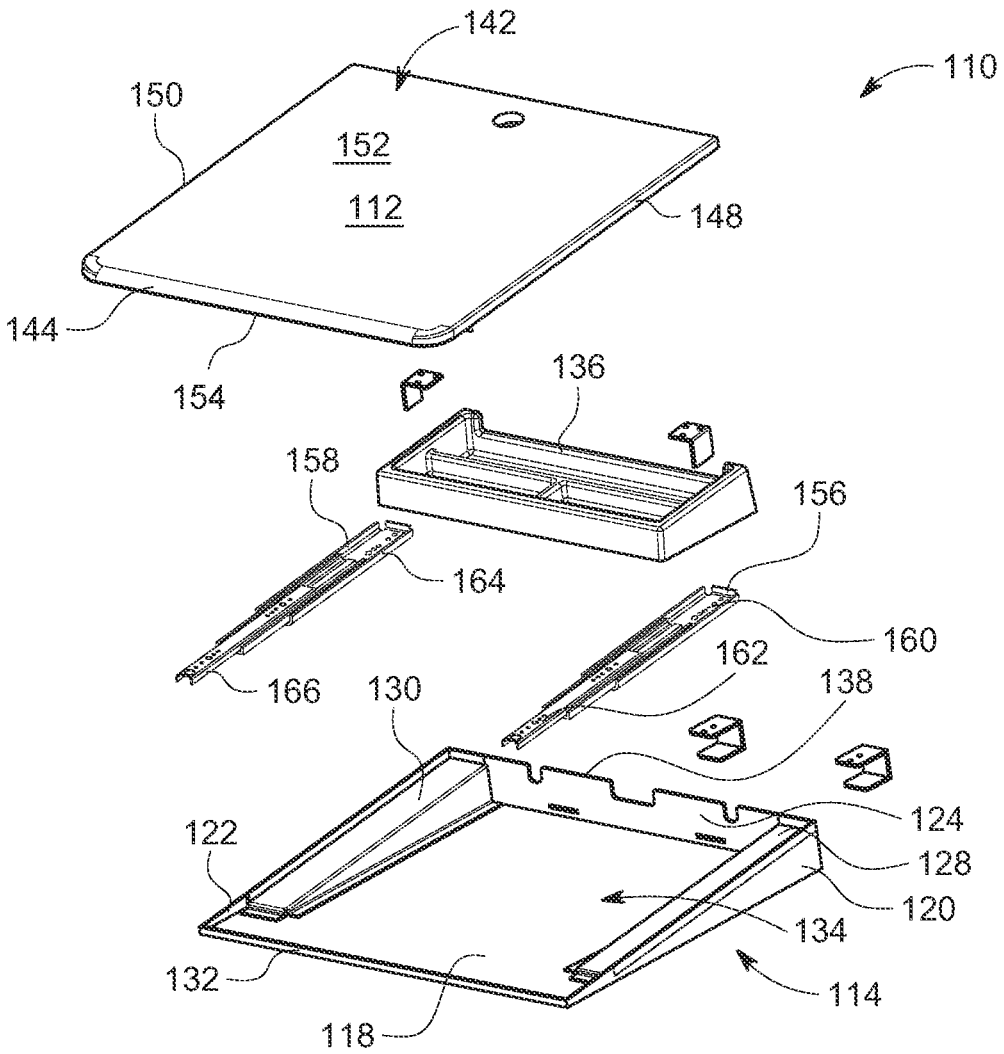
FIG. 3 illustrates an exploded view of the work surface assembly of FIG. 1, in accordance with an embodiment of the disclosure.
Figure 4:
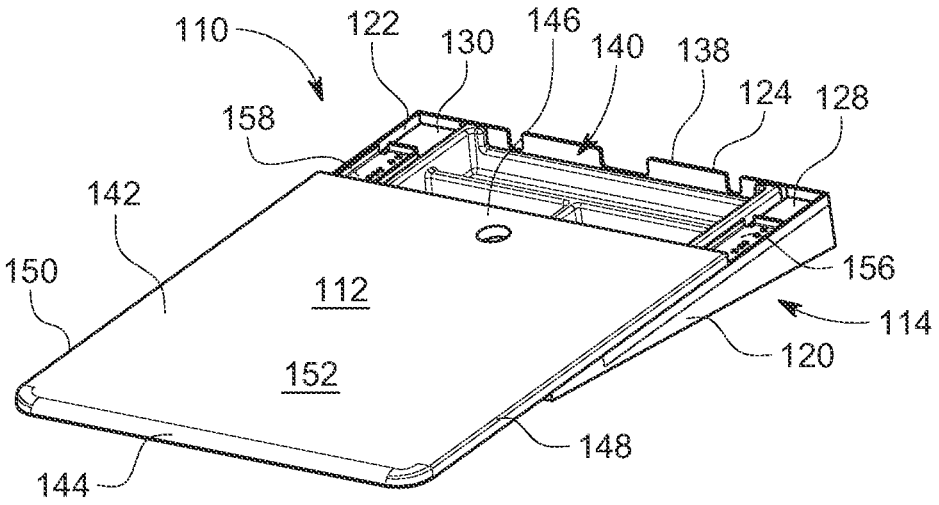
FIG. 4 illustrates a perspective view of the work surface assembly having a cover member arranged at an extended position, in accordance with an embodiment of the disclosure.

To facilitate the sliding movement of the cover member 142 relative to the base structure 114, the work surface assembly 110 can optionally include a pair of desk sliders, for example, a first desk slider 156 and a second desk slider 158, attached to the cover member 142. As shown in FIGS. 3 and 4, the first desk slider 156 extends over the length of the first sidewall 120 and is engaged to the first ramp 128, while the second desk slider 158 extends over the length of the second sidewall 122 and is engaged to the second ramp 130. In an embodiment, the first desk slider 156 may include a telescopic structure having a first arm 160 attached to the first sidewall 120 or the first ramp 128 and a second arm 162 attached to the second surface 154 of the cover member 142 and adapted to telescopically extend or retract relative to the first arm 160. Similar to the first desk slider 156, the second desk slider 158 may include a telescopic structure having a first arm 164 attached to the second sidewall 122 or the second ramp 130 and a second arm 166 attached to the second surface 154 of the cover member 142 and adapted to telescopically extend or retract relative to the first arm 164.

Figure 5:
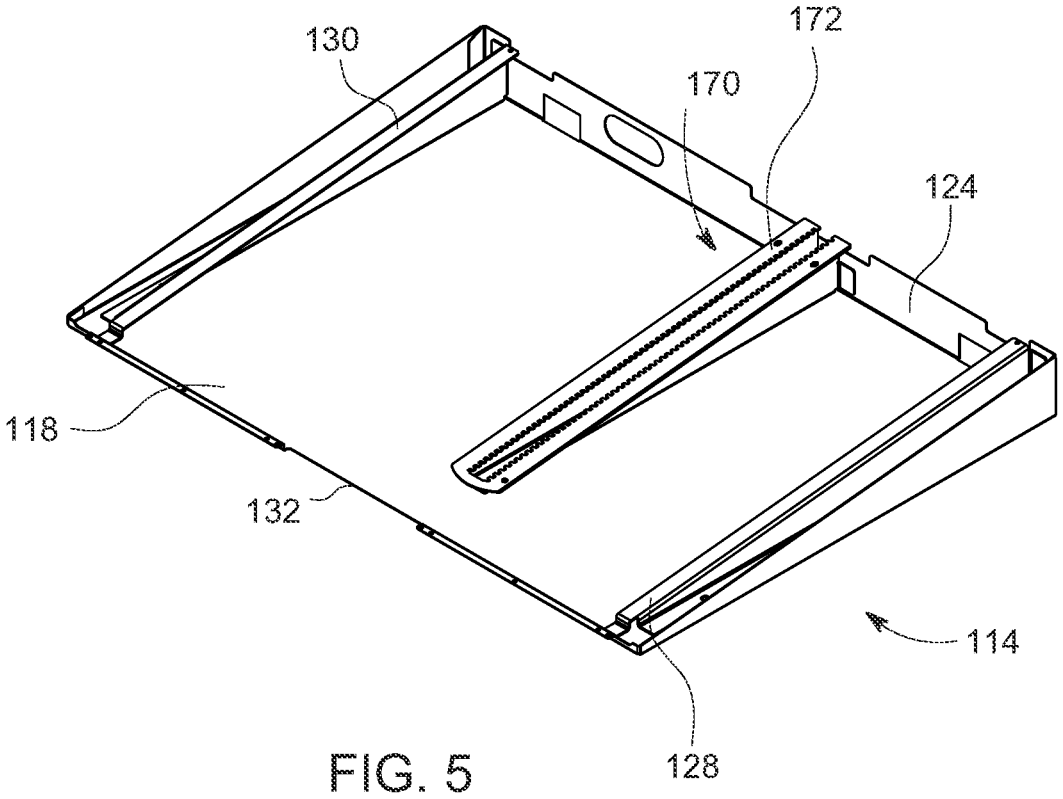
FIG. 5 illustrates a perspective view of the work surface assembly with a cover member removed and depicting a ramp structure of the work surface assembly, in accordance with an embodiment of the disclosure.
Figure 6:
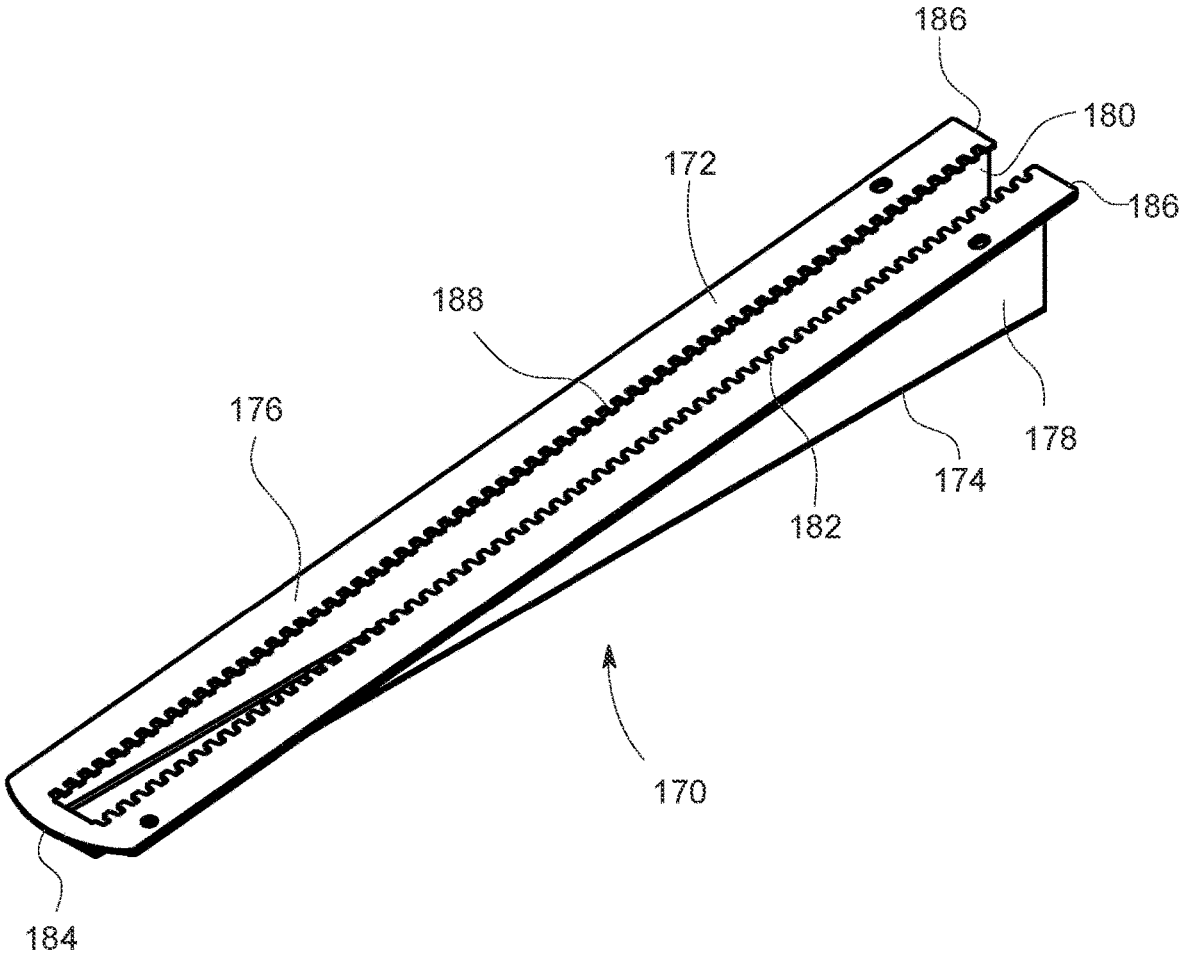
FIG. 6 illustrates an enlarged perspective view of the ramp structure of the work surface assembly, in accordance with an embodiment of the disclosure.
Figure 7:
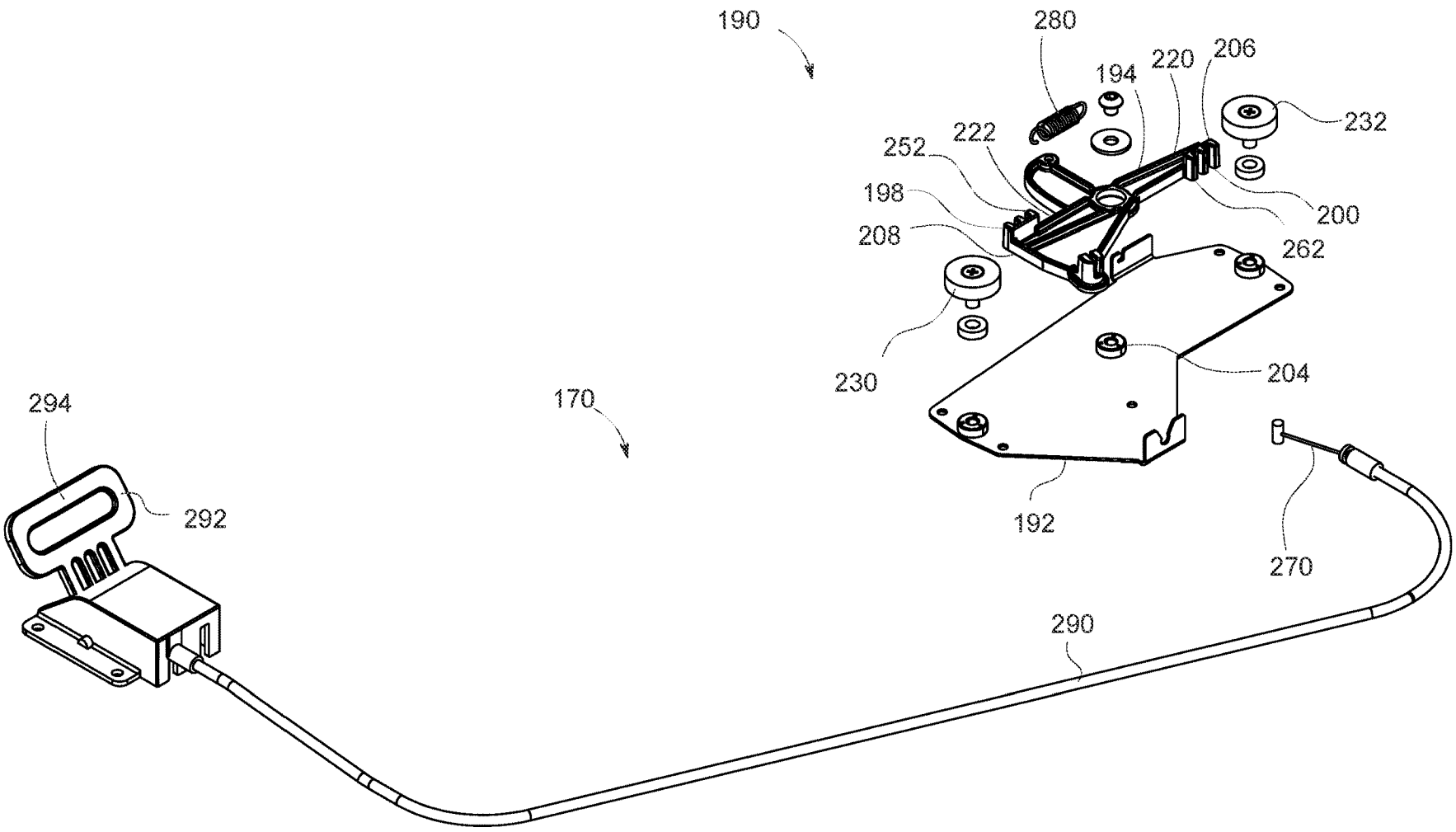
FIG. 7 illustrates an exploded view of the brake structure removed from the work surface assembly, in accordance with an embodiment of the disclosure.
Figure 8:
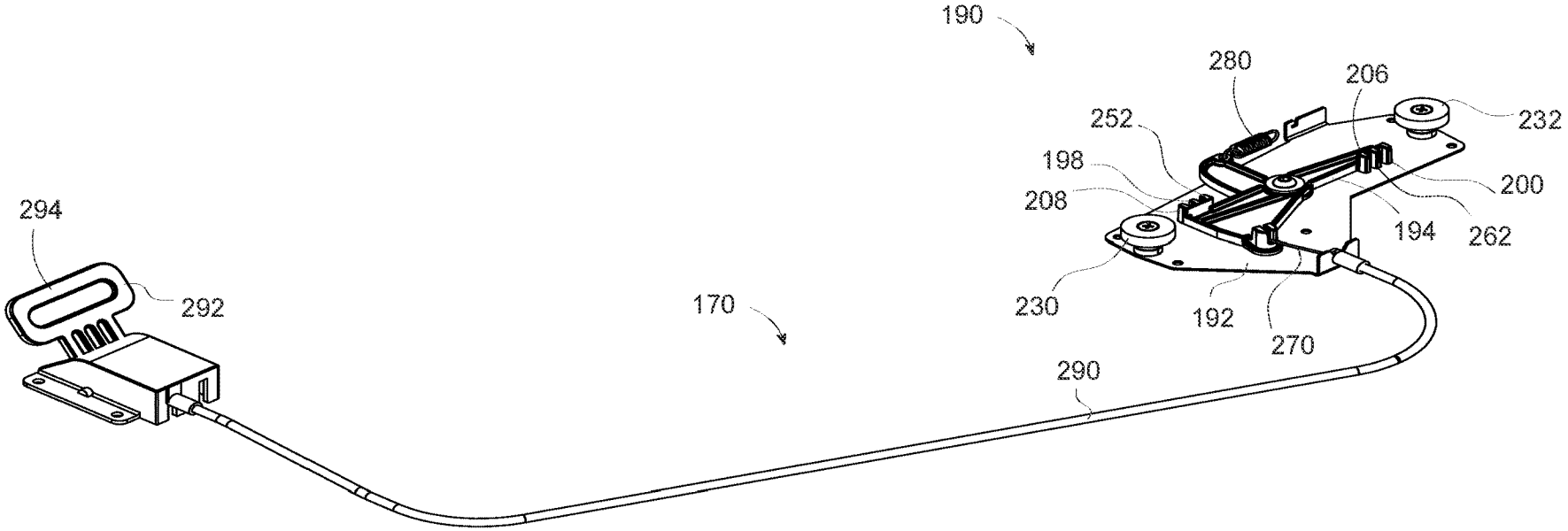
FIG. 8 illustrates a perspective of the brake structure of the brake assembly, in accordance with an embodiment of the disclosure.

To hold the cover member 142 relative to the base structure 114 in any intermediate position between the extended position and the retracted position, the work surface assembly 110 may include a brake assembly 170 (shown in FIGS. 5-8) attached to the base structure 114 and the second surface 154 of the cover member 142, although the brake assembly 170 is not shown attached to the cover member 142 in FIGS. 7 and 8. Referring to FIGS. 5 and 6, the brake assembly 170 includes a ramp structure 172 attached to the bottom plate 118 and disposed inside the chamber 134. The ramp structure 172 extends outwardly and upwardly from the bottom plate 118 and includes a bottom surface 174 adapted to abut with the bottom plate 118, and an inclined surface 176 extending rearwardly and obliquely towards the rear wall 124 at an angle relative to the bottom plate 118. Furthermore, the ramp structure 172 includes a first side surface 178 extending from the bottom surface 174 to the inclined surface 176, and a second side surface 180 disposed opposite to the first side surface 178 and extending from the bottom surface 174 to the inclined surface 176. Furthermore, the ramp structure 172 includes a plurality of first teeth 182 arrayed linearly between a front edge 184 to a rear edge 186 along the first side surface 178, and a plurality of second teeth 188 arrayed from the front edge 184 to the rear edge 186 along the second side surface 180. Accordingly, the first teeth 182 and the second teeth 188 are arranged opposite to each other and extend generally in a vertical direction from the bottom surface 174 to the inclined surface 176.

The brake assembly 170 also includes a brake structure 190 adapted to slidingly engage with the ramp structure 172 to hold the cover member 142 in any intermediate position. Referring to FIGS. 7 and 8, the brake structure 190 includes a bracket 192 adapted to couple with the bottom surface, or second surface 154 of the cover member 142 (not shown in FIGS. 7 and 8), and a lever 194 pivotally engaged with the bracket 192. The lever 194 includes a pair of toothed members 198, 200 adapted to engage with the first teeth 182 and the second teeth 188 of the ramp structure 172 to prevent the cover member 142 from sliding relative to the base structure 114 and to hold the cover member 142 in any intermediate position. As shown in FIG. 7, the bracket 192 includes a fulcrum 204 disposed between a first longitudinal end 206 and a second longitudinal end 208 of the lever 194. The lever 194 is pivotally coupled to the bracket 192 at the fulcrum 204 with a pivot axis being substantially perpendicular to the second surface 154 of the cover member 142.

The lever 194 may include an "I" shape having a pair of opposed linear structures, for example, a first linear structure 220 and a second linear structure 222. The fulcrum 204 is arranged between the first linear structure 220 and the second linear structure 222. The lever 194 extends along a length of the cover member 142, and is engaged/coupled/attached with the pair of toothed members 198, 200, respectively.

The pair of toothed members, for example, a first toothed member 198 and second toothed member 200 are arranged such that the lever 194 is disposed between the bracket 192 and the ramp structure 172. As shown, the first toothed member 198 includes an array of teeth 252 extending outwardly from the second linear structure 222, and the second toothed member 200 includes an array of teeth 262 extending outwardly from the first linear structure 220. The first toothed member 198 and the second toothed member 200 are positioned between, and adapted to engage with, the first teeth 182 and the second teeth 188, respectively. Accordingly, the teeth 252 are adapted to engage with the first teeth 182, and the teeth 262 are adapted to engage with the second teeth 188 to facilitate a braking and retention of the cover member 142 with the base structure 114 to prevent the sliding of the cover member 142 relative to the base structure 114. As such, the first toothed member 198 and the second toothed member 200 are biased to an engaged position by a spring 280 in which the teeth 252 remain engaged with the first teeth 182, and the teeth 262 remain engaged with the second teeth 188 of the ramp structure 172 to hold the cover member 142 stationary relative to the base structure 114.

Furthermore, there is provided a first guide wheel 230 and a second guide wheel 232 which are secured to the bracket 192 and freely rotate therewith. When assembled, the first guide wheel 230 and a second guide wheel 232 are both positioned between the first side surface 178 and the second side surface 180 so as to guide the brake structure 190 along the inclined surface 176 and between the first side surface 178 and the second side surface 180.

To move the first toothed member 198 and the second toothed member 200 to a disengaged position, the lever 194 is rotated about the fulcrum 204 by pulling a cable 270 attached to the second longitudinal end 208 of the lever 194. When the cable 270 is pulled, the spring 280 is stretched and the lever 194 rotates about the fulcrum 204, thereby disengaging the first toothed member 198 from the first teeth 182, and disengaging the second toothed member 200 from the second teeth 188. And as a result, the brake structure 190 and the cover member 142 are able to slide freely along the ramp structure 172 and the base structure 114 of the work surface assembly 110. The cable 270 slides in a translating back-and-forth motion within a cable sheath 290. The opposed end of the cable 270 is attached to a switch 292, which is preferably in the form of a manually-activated lever 294, as shown.

A method of using the table 100 is now described. The user may initially move the cover member 142 to the retracted position to use the work surface 112 while sitting on a chair in an upright position. After working for a relatively long time or as otherwise desired, the user may wish to recline on the chair while still being able to use the work surface 112. Thus, the user may activate the switch 292, such as by pulling the manually-activated lever 294 toward the cover member 142, which in turn slides the cable 270 through the cable sheath 290 and pulls the second longitudinal end 208 of the lever 194, thereby rotating the lever 194 about the fulcrum 204, and in turn disengaging the teeth 252 of the first toothed member 198 from the first teeth 182 of the ramp structure 172, and disengaging the teeth 262 of the second toothed member 200 from the second teeth 188 of the ramp structure 172. Accordingly, the cover member 142 can then slide relative to the base structure 114 to the extended position or any intermediate position. After appropriately positioning the cover member 142 to the desired position, the user may release the switch 292, and then also the cable 270. Upon release of the cable 270, the first toothed member 198 and the second toothed member 200 move back to the respective engaged positions due to the biasing force of the spring 280. Accordingly, the cover member 142 is then held stationary relative to the base structure 114 at a position desired by the user, thereby enabling the use of the work surface 112 in the reclined position.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

What is claimed is:

1. A workstation comprising:

a tabletop having a tabletop surface and a work surface assembly, the work surface assembly including;

a base structure having a bottom plate;

a cover member supported by the base structure and defining a work surface arranged at an inclination relative to the tabletop surface, the cover member is adapted to slide relative to the base structure between an extended position and a retracted position; and a brake assembly adapted to selectively prevent the cover member from sliding relative to base structure and hold the cover member stationary with the base structure at any position between the extended position and the retracted position;

wherein the brake assembly includes a ramp structure positioned atop the bottom plate of the base structure, the ramp structure extending upwardly from the bottom plate, and the ramp structure having a bottom surface, a front edge, a rear edge, a first side surface, a second side surface, and an inclined surface extending upwardly from the front edge to the rear edge, the ramp structure further including a plurality of first teeth arrayed linearly between the front edge and the rear edge.

2. The workstation of claim 1 wherein the ramp structure includes a plurality of second teeth arrayed linearly between the front edge and the rear edge, the plurality of first teeth being positioned along the first side surface and the plurality of second teeth being positioned along the second side surface, and the plurality of first teeth and the plurality of second teeth extending toward one another.

3. The workstation of claim 1 wherein the brake assembly includes a brake structure adapted to slidingly engage with the ramp structure, the brake structure being secured to the cover member, the brake structure is selectively engaged or disengaged with the ramp structure, and the brake structure is biased to be engaged with the ramp structure.

4. The workstation of claim 3 wherein the brake structure includes a pivoting lever having a first linear structure, and a second linear structure that is opposed to the first linear structure, and a fulcrum positioned between the first linear structure and the second linear structure.

5. The workstation of claim 4 wherein the second linear structure includes a first toothed member, and the first linear structure includes a second toothed member, and the first toothed member and second toothed member are positioned between the plurality of first teeth and a plurality of second teeth, whereby the brake structure is selectively engaged when the pivoting lever is rotated such that the first toothed member engages with the first teeth of the ramp structure, and the second toothed member engages with the second teeth of the ramp structure, and whereby the brake structure is selectively disengaged when the pivoting lever is rotated such that the first toothed member disengages from the first teeth of the ramp structure, and the second toothed member disengages from the second teeth of the ramp structure.

6. The workstation of claim 5 wherein the brake structure includes a spring that biases the brake structure to be engaged with the ramp structure.

7. The workstation of claim 5 including a cable attached on a first end to the pivoting lever and attached on a second end to a switch, whereby the switch can be selectively activated to move the pivoting lever to cause the brake structure to be engaged or disengaged with the ramp structure.

8. The workstation of claim 1 including a storage chamber within the base structure.

9. The workstation of claim 1 including at least one desk slider attached to the cover member and the base structure to allow the cover member to slide over the base structure.

10. A work surface assembly for placement on a tabletop, the work surface assembly comprising:

a base structure having a bottom plate;

a cover member supported by the base structure and defining a work surface arranged at an incline, the cover member is adapted to slide relative to the base structure between an extended position and a retracted position; and a brake assembly adapted to selectively prevent the cover member from sliding relative to base structure and hold the cover member stationary with the base structure at any position between the extended position and the retracted position;

wherein the brake assembly includes a ramp structure positioned atop the bottom plate of the base structure, the ramp structure extending upwardly from the bottom plate, and the ramp structure having a bottom surface, a front edge, a rear edge, a first side surface, a second side surface, and an inclined surface extending upwardly from the front edge to the rear edge, the ramp structure further including a plurality of first teeth arrayed linearly between the front edge and the rear edge.

11. The work surface assembly of claim 10 wherein the ramp structure includes a plurality of second teeth arrayed linearly between the front edge and the rear edge, the plurality of first teeth being positioned along the first side surface and the plurality of second teeth being positioned along the second side surface, and the plurality of first teeth and the plurality of second teeth extending toward one another.

12. The work surface assembly of claim 10 wherein the brake assembly includes a brake structure adapted to slidingly engage with the ramp structure, the brake structure being secured to the cover member, the brake structure is selectively engaged or disengaged with the ramp structure, and the brake structure is biased to be engaged with the ramp structure.

13. The work surface assembly of claim 12 wherein the brake structure includes a pivoting lever having a first linear structure, and a second linear structure that is opposed to the first linear structure, and a fulcrum positioned between the first linear structure and the second linear structure.

14. The work surface assembly of claim 13 wherein the second linear structure includes a first toothed member, and the first linear structure includes a second toothed member, and the first toothed member and second toothed member are positioned between the plurality of first teeth and a plurality of second teeth, whereby the brake structure is selectively engaged when the pivoting lever is rotated such that the first toothed member engages with the first teeth of the ramp structure, and the second toothed member engages with the second teeth of the ramp structure, and whereby the brake structure is selectively disengaged when the pivoting lever is rotated such that the first toothed member disengages from the first teeth of the ramp structure, and the second toothed member disengages from the second teeth of the ramp structure.

15. The work surface assembly of claim 14 wherein the brake structure includes a spring that biases the brake structure to be engaged with the ramp structure.

16. The work surface assembly of claim 14 including a cable attached on a first end to the pivoting lever and attached on a second end to a switch, whereby the switch can be selectively activated to move the pivoting lever to cause the brake structure to be engaged or disengaged with the ramp structure.

17. The work surface assembly of claim 10 including a storage chamber within the base structure.

18. The work surface assembly of claim 10 including at least one desk slider attached to the cover member and the base structure to allow the cover member to slide over the base structure.

* * * * *